US006921420B2

(12) United States Patent
Brainard et al.

(10) Patent No.: US 6,921,420 B2
(45) Date of Patent: Jul. 26, 2005

(54) APPARATUS AND METHODS FOR CONSERVING VAPOR IN A CARBON DIOXIDE DRY CLEANING SYSTEM

(75) Inventors: David E. Brainard, Knightdale, NC (US); James B. McClain, Raleigh, NC (US); Michael E. Cole, Raleigh, NC (US); Steve L. Worm, Raleigh, NC (US)

(73) Assignee: Micell Technologies, Raleigh, NC (US)

( * ) Notice: Subject to any disclaimer, the term of this patent is extended or adjusted under 35 U.S.C. 154(b) by 19 days.

(21) Appl. No.: 10/893,817

(22) Filed: Jul. 19, 2004

(65) Prior Publication Data

US 2004/0255393 A1 Dec. 23, 2004

Related U.S. Application Data

(62) Division of application No. 10/696,612, filed on Oct. 29, 2003, now Pat. No. 6,795,991, which is a division of application No. 10/044,382, filed on Jan. 11, 2002, now Pat. No. 6,666,050, which is a division of application No. 09/404,957, filed on Sep. 24, 1999, now Pat. No. 6,397,421.

(51) Int. Cl.[7] ..... D06B 5/24

(52) U.S. Cl. ..... 8/149.1; 8/158; 68/18 R; 68/18 C

(58) Field of Search ..... 8/149.1, 158, 159; 68/17 R, 18 R, 18 C, 207

(56) References Cited

U.S. PATENT DOCUMENTS 2,074,508 A 3/1937 Hetzer
4,012,194 A 3/1977 Maffei (Continued)

FOREIGN PATENT DOCUMENTS

EP 0 527 669 A1 2/1993
EP 0 828 020 A2 3/1998

(Continued)

OTHER PUBLICATIONS

US 6,001,133, 12/1999, DeYoung et al. (withdrawn)
PCT International Search Report for Int'l Appl. No. PCT/US99/06383, dated, Jul. 22, 1999.

(Continued)

*Primary Examiner*—Frankie L. Stinson
(74) *Attorney, Agent, or Firm*—Myers Bigel Sibley & Sajovec, P.A.

(57) ABSTRACT

A method for conserving carbon dioxide vapor in a carbon dioxide dry cleaning system employing a liquid carbon dioxide cleaning solution to clean articles, where the method includes removing carbon dioxide vapor from a wash tank to a vapor tank, storing the carbon dioxide vapor in the vapor tank; and charging the wash tank with carbon dioxide vapor from the vapor tank. The method may be performed as part of a wash cycle that includes filling the wash tank with cleaning solution, washing articles to be cleaned in the wash tank, and emptying the cleaning solution out of the wash tank. An apparatus may also be employed for conserving carbon dioxide vapor in a carbon dioxide dry cleaning system employing a liquid carbon dioxide cleaning solution to clean articles, where the apparatus includes a wash tank for contacting the articles to be cleaned with the liquid carbon dioxide cleaning solution, a working tank for storing liquid carbon dioxide cleaning solution, a vapor tank for storing carbon dioxide vapor, a first piping system providing fluid communication between the wash tank and the vapor tank, where the first piping system includes a first line and a first valve residing in the first line, and a second piping system providing fluid communication between the working tank and the wash tank. Methods and apparatus for collecting liquid carbon dioxide in a collecting tank are also provided.

7 Claims, 2 Drawing Sheets

U.S. PATENT DOCUMENTS

| | | | | |
|---|---|---|---|---|
| 4,219,333 | A | | 8/1980 | Harris |
| 4,243,056 | A | | 1/1981 | de la Burde et al. |
| 4,877,530 | A | | 10/1989 | Moses |
| 4,923,720 | A | | 5/1990 | Lee et al. |
| 4,936,922 | A | | 6/1990 | Cherry |
| 5,013,366 | A | | 5/1991 | Jackson et al. |
| 5,027,742 | A | | 7/1991 | Lee et al. |
| 5,267,455 | A | | 12/1993 | Dewees et al. |
| 5,339,844 | A | | 8/1994 | Stanford, Jr. et al. |
| 5,412,958 | A | | 5/1995 | Iliff et al. |
| 5,434,332 | A | | 7/1995 | Cash |
| 5,467,492 | A | | 11/1995 | Chao et al. |
| 5,630,434 | A | * | 5/1997 | Gray et al. ..... 134/10 |
| 5,651,276 | A | | 7/1997 | Purer et al. |
| 5,669,251 | A | | 9/1997 | Townsend et al. |
| 5,676,705 | A | | 10/1997 | Jureller et al. |
| 5,683,473 | A | | 11/1997 | Jureller et al. |
| 5,683,977 | A | | 11/1997 | Jureller et al. |
| 5,766,637 | A | | 6/1998 | Shine et al. |
| 5,784,905 | A | | 7/1998 | Townsend et al. |
| 5,822,818 | A | | 10/1998 | Chao et al. |
| 5,858,022 | A | | 1/1999 | Romack et al. |
| 5,904,737 | A | | 5/1999 | Preston et al. |
| 5,908,510 | A | | 6/1999 | McCullough et al. |
| 5,925,192 | A | | 7/1999 | Purer et al. |
| 5,937,675 | A | | 8/1999 | Stucker |
| 5,943,721 | A | | 8/1999 | Lerette et al. |
| 5,946,945 | A | | 9/1999 | Kegler et al. |
| 5,961,671 | A | | 10/1999 | Guindy et al. |
| 5,968,285 | A | | 10/1999 | Ferrell et al. |
| 5,970,554 | A | | 10/1999 | Shore et al. |
| 5,976,264 | A | | 11/1999 | McCullough et al. |
| 5,977,045 | A | | 11/1999 | Murphy |
| 5,996,155 | A | | 12/1999 | Chao et al. |
| 6,012,307 | A | | 1/2000 | Malchow |
| 6,050,112 | A | | 4/2000 | Walker |
| 6,070,440 | A | | 6/2000 | Malchow et al. |
| 6,082,150 | A | | 7/2000 | Stucker |
| 6,212,916 | B1 | | 4/2001 | Carr |
| 6,216,302 | B1 | | 4/2001 | Preston et al. |
| 6,260,390 | B1 | | 7/2001 | Carr |
| 6,360,392 | B1 | | 3/2002 | Malchow |
| 6,481,247 | B1 | | 11/2002 | Fedegari |

FOREIGN PATENT DOCUMENTS

| | | |
|---|---|---|
| EP | 0 828 020 A3 | 3/1998 |
| EP | 0 846 799 | 6/1998 |
| EP | 0 919 659 A2 | 6/1999 |
| WO | WO 97/33031 | 9/1997 |
| WO | WO 99/10587 | 3/1999 |
| WO | WO 99/13148 | 3/1999 |
| WO | WO 99/49122 | 9/1999 |
| WO | WO 99/57358 | 11/1999 |

OTHER PUBLICATIONS

PCT International Search Report for Int'l Appl. No. PCT/US00/25786, dated Feb. 1, 2001.

Barton, Jerome C., *The Los Alamos Super Scrub™: Supercritical Carbon Dioxide System Utilities and Consumables Study,* Los Alamos National Laboratory, LA–12786, UC–321, Issued Jun. 1994.

Spall Dale, W, et al., *Precision Cleaning with Supercritical Carbon Dioxide for the Elimination of Organic Solvents and the Reduction of Hazardous Waste,* Los Alamos National Laboratory, Submitted to: 9$^{th}$ Annual Aerospace Hazardous Materials Management Conference, Denver, CO, Sep. 28–30, 1994.

Williams, Sarah B, et al., *Elimination of Solvents and Waste by Supercritical Carbon Dioxide in Precision Cleaning,* Los Alamos National Laboratory, Submitted to: American Chemical Society Emerging Technologies in Hazardous Management VI, Atlanta, GA Sep. 19–21, 1994.

Williams, Sarah B. et al., *Fabric Compatibility and Cleaning Effectiveness of Drycleaning with Carbon Dioxide,* Los Alamos National Laboratory, Presentation at European Drycleaning Conference, Milan, Italy, Mar. 9–16, 1996.

* cited by examiner

APPARATUS AND METHODS FOR CONSERVING VAPOR IN A CARBON DIOXIDE DRY CLEANING SYSTEM

RELATED APPLICATIONS

This application is a divisional of and claims priority from U.S. patent application Ser. No. 10/696,612, filed Oct. 29, 2003, now U.S. Pat. No. 6,795,991 which is a divisional of and claims priority from U.S. patent application Ser. No. 10/044,382, filed Jan. 11, 2002, now U.S. Pat. No. 6,666, 050, issued Dec. 23, 2003, which is a divisional of and claims priority from U.S. patent application Ser. No. 09/404, 957, filed Sep. 24, 1999, now U.S. Pat. No. 6,397,421, issued Jun. 4, 2002, the disclosures of which are incorporated by reference herein in their entireties.

FIELD OF THE INVENTION

This invention relates to methods and apparatus for conserving vapor and collecting liquid carbon dioxide for cleaning systems, more particularly to methods and apparatus for conserving vapor and collecting liquid carbon dioxide for carbon dioxide dry cleaning systems.

BACKGROUND OF THE INVENTION

Organic solvents such as perchloroethylene and other low-pressure liquid solvents have long been popular for use in cleaning systems such as dry cleaning systems. Recently, however, there are growing concerns that these solvents may harm the environment and pose occupational safety hazards. These concerns have led to an extensive search for alternative solvents that are less hazardous and systems for applying such solvents.

Some of this research has focused on systems utilizing solvents that are gases at low pressure. These systems may operate either under subcritical conditions such that the solvent is present as a liquid or under supercritical conditions such that the solvent is present as a supercritical fluid. Some of these systems utilize liquid carbon dioxide ($CO_2$) as a cleaning solvent.

PCT Publication WO 99/13148 to Shore et al. describes a cleaning system using liquid $CO_2$. Shore describes evacuating a cleaning chamber to remove air from the chamber. Shore also discusses filling the chamber with carbon dioxide gas from either a distillation vessel or a liquid $CO_2$ storage tank as part of a prefill mode. Shore further describes how draining liquid carbon dioxide from the cleaning chamber leaves carbon dioxide gas in the chamber and discusses an apparatus for reclaiming this gas using a compressor and a condenser to return reliquified CO2 to a liquid storage tank.

The system described by Shore is inefficient making it expensive to operate and expensive to construct. For example, filling the cleaning chamber with CO2 gas from a distillation vessel requires that a distillation vessel be supplied and operated. Alternatively, using vaporization of the liquid CO2 in the storage tank requires the storage tank to contain a heater sized to provide make-up heat equal to the heat of vaporization of the liquid CO2 that is converted to vapor.

Furthermore, a condenser must be supplied which is sized to handle the extreme vapor loads experienced at the beginning of the vapor reclamation step. Additionally, cooling must be supplied to this condenser. Other methods for removing the CO2 gas from the cleaning chamber such as venting to atmosphere, which results in loss of CO2 from the system, or sparging as described in PCT Publication WO 97/33031 to Taricco are similarly inefficient.

A small amount of air in the system may be beneficial, providing a partial pressure in the liquid CO2 storage tank and resulting in increased net positive suction head for the pump. However, the efficiency of the condenser can be drastically affected by even small amounts of air. Thus, a vacuum pump must be operated before each cycle to ensure that all air has been evacuated from the cleaning chamber.

Further inefficiencies occur in carbon dioxide cleaning systems that employ cleaning solutions comprising liquid carbon dioxide and other additives or detergents. To create a source of liquid CO2, these systems rely on evaporators or stills to separate additives and contaminants from the cleaning solution and generate CO2vapor. Such stills and evaporators require heating elements, which must be sized to supply sufficient $CO_2$ vapor and operated using steam or electricity.

SUMMARY OF THE INVENTION

It is therefore an object of the present invention to provide methods and apparatus for improving the thermodynamic efficiency of a liquid carbon dioxide dry cleaning system.

It is another object of the present invention to provide methods and apparatus for lowering the capital costs associated with a liquid carbon dioxide dry cleaning system.

These and other objects are provided, according to the present invention, by an apparatus for conserving carbon dioxide vapor in a carbon dioxide dry cleaning system employing a liquid carbon dioxide cleaning solution to clean articles, where the apparatus includes a wash tank for contacting the articles to be cleaned with the liquid carbon dioxide cleaning solution, a working tank for storing liquid carbon dioxide cleaning solution, a vapor tank for storing carbon dioxide vapor, a first piping system providing fluid communication between the wash tank and the vapor tank where the first piping system includes a first line and a first valve residing in the first line, and a second piping system providing fluid communication between the working tank and the wash tank.

According to the present invention, the first valve may be sized to limit vapor flow rate through the first line.

In a preferred embodiment, the apparatus includes a compressor for transferring carbon dioxide vapor between the wash tank and the vapor tank, where the compressor resides in the first piping system, a third piping system providing fluid communication between the working tank and the first piping system, and a condenser for condensing carbon dioxide vapor to liquid carbon dioxide, where the condenser resides in the third piping system.

According to the present invention, a method for conserving carbon dioxide vapor in a carbon dioxide dry cleaning system employing a liquid carbon dioxide cleaning solution to clean articles may also be employed, which includes removing carbon dioxide vapor from a wash tank to a vapor tank, storing the carbon dioxide vapor in the vapor tank and charging the wash tank with carbon dioxide vapor from the vapor tank. By conserving the carbon dioxide vapor, a condenser may not be needed, which may reduce or eliminate the need to remove air from the system at the beginning of each wash cycle. Thus, the need for a vacuum pump may be reduced or even eliminated resulting in lower capital costs and operating expenses. Furthermore, higher concentrations of air in the system may increase the efficiency of the system by providing a partial pressure in the head-space of the working tank, resulting in increased net positive suction head for a pump.

In a preferred embodiment, removing carbon dioxide vapor from a wash tank to a vapor tank includes transferring carbon dioxide vapor from the wash tank having a higher pressure to the vapor tank having a lower pressure utilizing a piping system, pumping the carbon dioxide vapor out of the wash tank using a compressor when the differential pressure between the wash tank and the vapor tank is less than about 100 psig, condensing a portion of the carbon dioxide vapor into liquid carbon dioxide in a condenser, storing the liquid carbon dioxide in a working tank, stopping the compressor when the pressure in the wash tank is less than about 100 psig, and venting carbon dioxide from the wash tank to atmosphere. Charging the wash tank with carbon dioxide vapor from the vapor tank includes transferring carbon dioxide vapor from the vapor tank having a higher pressure to the wash tank having a lower pressure utilizing a piping system, pumping the carbon dioxide vapor out of the vapor tank using a compressor when the differential pressure between the vapor tank and the wash tank is less than about 100 psig, generating carbon dioxide vapor in a working tank, stopping the compressor when the pressure in the wash tank is less than about 50 psig, and venting carbon dioxide from the wash tank to atmosphere.

By condensing only a portion of the carbon dioxide vapor, the size of the condenser may be reduced resulting in lower capital costs and the heat removed from the condenser may be reduced resulting in increased thermodynamic efficiency.

According to the present invention, an apparatus may also be employed for collecting liquid carbon dioxide in a carbon dioxide dry cleaning system employing a liquid carbon dioxide cleaning solution to clean articles, where the apparatus includes a vapor tank, a condenser, a working tank containing carbon dioxide cleaning solution, a wash tank, a liquid carbon dioxide collecting tank, a first piping system providing fluid communication between the condenser, the working tank, and the liquid carbon dioxide collecting tank, a second piping system providing fluid communication between the liquid carbon dioxide collecting tank and the wash tank, and a third piping system providing fluid communication between the wash tank and the vapor tank.

According to the present invention, a method may also be employed for supplying a liquid carbon dioxide solution to a wash tank for a carbon dioxide dry cleaning system, utilizing a vapor tank, a condenser, a liquid carbon dioxide collecting tank, a working tank containing carbon dioxide cleaning solution, and a wash tank, where the method includes draining a solution comprising liquid carbon dioxide from the wash tank leaving carbon dioxide vapor in the wash tank, transferring the carbon dioxide vapor from the wash tank to a vapor tank, condensing a portion of the carbon dioxide vapor transferred to the vapor tank to form liquid carbon dioxide, collecting the liquid carbon dioxide in the liquid carbon dioxide collecting tank, and draining the contents of the liquid carbon dioxide collecting tank into the wash tank. By conserving the carbon dioxide vapor left in the wash tank after draining a solution comprising liquid carbon dioxide, transferring this vapor from a wash tank to a vapor tank, and condensing a portion of this conserved carbon dioxide vapor to form liquid carbon dioxide rather than generating carbon dioxide vapor in an evaporator or the like, the need for an evaporator and like equipment may be reduced or eliminated, which may reduce capital and operating costs and may improve the thermodynamic efficiency of the cleaning system.

In a preferred embodiment, the method includes rinsing articles in the wash tank with liquid carbon dioxide after the draining step and emptying the contents of the wash tank into the working tank.

In yet another preferred embodiment, the method includes injecting additives into the liquid carbon dioxide collecting tank to form a filter wash solution after the collecting step and before the draining step, washing at least one filter with the contents of the liquid carbon dioxide collecting tank after the draining step, and emptying the wash tank.

Methods and apparatus according to the present invention may therefore improve the thermodynamic efficiency of and reduce the capital costs associated with a liquid carbon dioxide dry cleaning system. It will be understood that the present invention may be embodied as methods and apparatus and combinations thereof.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
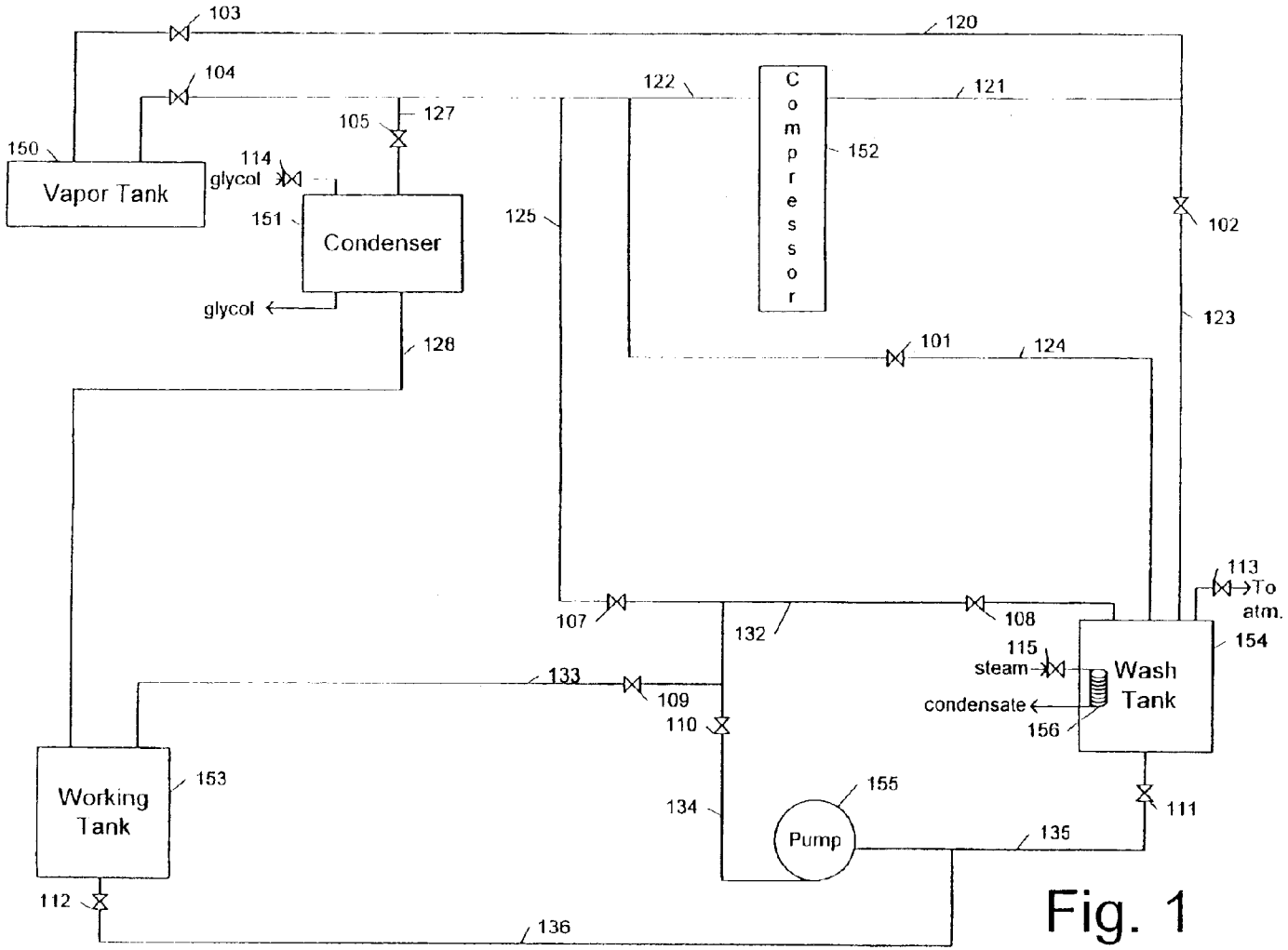
FIG. 1 illustrates a carbon dioxide dry cleaning system employing a vapor tank according to the present invention.

Referring first to FIG. 1, a wash cycle will be described, focusing particularly on charging carbon dioxide vapor into and removing carbon dioxide vapor from wash tank 154. In general, a wash cycle may be performed in the following steps: (1) placing clothes to be cleaned into wash tank 154; (2) charging carbon dioxide vapor into wash tank 154 to pressurize it; (3) transferring liquid cleaning solution, comprising liquid carbon dioxide as a solvent, from working tank 153 to wash tank 154 via pump 155; (4) washing clothes in wash tank 154; (5) draining liquid cleaning solution from wash tank 154 and transferring liquid cleaning solution via pump 155 back to working tank 153; (6) extracting remaining liquid cleaning solution from clothes in wash tank 154; (7) removing carbon dioxide vapor from wash tank 154 to depressurize it; and (8) removing clean clothes from wash tank 154. For illustrative purposes, this description will begin in the middle of a wash cycle, at the washing step, and end at the washing step in the next wash cycle. Valves 101–115 are shut, compressor 152 and pump 155 are secured, and system pressure and temperature are at or near saturated conditions for the given cleaning solution, preferably between about 55 to 62° F. (10 to 17° C.) at between about 681 to 756 psig for a carbon dioxide based system. One who is skilled in the art will understand that carbon dioxide dry cleaning systems can be operated at a variety of pressures and temperatures.

After washing clothes in wash tank 154 for a sufficient amount of time, the liquid cleaning solution may be drained from wash tank 154 by opening valves 109, 110, 111, 101, and 105 starting pump 155, which transfers the liquid cleaning solution from wash tank 154 through lines 135, 134, and 133 back to working tank 153. Once the liquid cleaning solution is transferred, pump 155 is secured and valves 109, 110, 111, 101, and 105 are shut. One who is skilled in the art will appreciate that lines may be selected from a group comprising piping, conduit, and other means of fluid communication that can withstand system temperature and pressure. Piping for the system is preferably schedule 40, stainless steel, and conforms to ANSI standards B31.3. One who is skilled in the art will also understand that a piping system may be comprised of one or more lines and that zero or more valves may reside in the one or more lines.

Any remaining liquid cleaning solution may be mechanically or otherwise extracted from the clothes in wash tank 154, and the remaining liquid cleaning solution may be drained from wash tank 154 using the drain procedure outlined above. At this point, the atmosphere in wash tank 154 is comprised primarily of carbon dioxide vapor.

Once the liquid cleaning solution has been drained, the carbon dioxide vapor in wash tank 154 may be removed to a vapor tank as follows, depressurizing wash tank 154 and allowing clean clothes to be removed. Valves 101 and 104 are opened, allowing the carbon dioxide vapor to move from wash tank 154 through lines 124 and 122 to vapor tank 150. Vapor tank 150 preferably has a volume of about 6 to about 60 $ft^3$ (about 0.17 to about 1.7 $m^3$). One skilled in the art will be able to select appropriate tanks to withstand system pressure and temperature by using, for example, the ASME Pressure Vessel Code. Valve 101 and line 124 may be sized to provide adequate restriction to the vapor flow to limit the velocity of this gas stream when the differential pressure between wash tank 154 and vapor tank 150 is at its greatest, about 700 psig or greater. Valve 101 is preferably a ½" full-flow ball valve, model #8450 commercially available from Watts Regulator Company of N. Andover, Mass. Line 124 is preferably a 1" schedule 40, stainless steel pipe conforming to ANSI standards B31.3. One who is skilled in the art could select a suitable valve to limit the flow rate resulting from other pressure differentials.

When this differential pressure has been reduced sufficiently, preferably less than 200 psi differential, valves 102 and 103 may be opened to facilitate vapor transfer by providing an additional flow path through lines 123 and 121. When the pressure differential between wash tank 154 and vapor tank 150 has been reduced such that it is less then about 100 psig, preferably less than about 50 psig, more preferable at or near zero, valves 101 and 103 are shut and compressor 152 is started. Compressor 152 pumps carbon dioxide vapor from wash tank 154 through lines 123, 121, and 122 to vapor tank 150. When the pressure in wash tank 154 is at or near atmospheric pressure, preferably less than about 100 psig, more preferably less than about 50 psig, compressor 152 is secured and valves 102 and 104 are shut. Any vapor remaining in wash tank 154 may be vented through valve 113. Wash tank 154 is now depressurized and clean clothes may be removed from it.

As just described, draining a solution comprising liquid carbon dioxide out of wash tank 154 may result in carbon dioxide vapor remaining in wash tank 154. Removing most if not all of this carbon dioxide vapor to a vapor tank rather than condensing it to liquid carbon dioxide conserves the carbon dioxide vapor for reuse in charging wash tank 154 at the beginning of a cycle. Thus, use of the vapor tank may eliminate the need for a condenser and may reduce the capital and operating costs of the cleaning system. Furthermore, conserving the carbon dioxide vapor for reuse in charging the wash tank at the beginning of a cycle may improve the thermodynamic efficiency of the system. Additionally, which may reduce or eliminate the need to remove air from the system at the beginning of each wash cycle. Thus, the need for a vacuum pump may be reduced or even eliminated resulting in lower capital costs and operating expenses. Furthermore, higher concentrations of air in the system may increase the efficiency of the system by providing a partial pressure in the head-space of the working tank, resulting in increased net positive suction head for a pump.

While compressor 152 may be used to remove all or almost all of the carbon dioxide vapor from wash tank 154 as just described, this process may be somewhat inefficient. As the pressure in vapor tank 150 builds, the compressor 152 reaches high compression ratios and the vapor transfer rate through compressor 152 decreases. Thus, compressor 152 may have to run for a long time to remove all or nearly all of the vapor from wash tank 154, resulting in energy and time inefficiencies. The vapor removal step described above may be augmented to utilize condenser 151, partially if not completely eliminating these inefficiencies by reducing the pressure in vapor tank 150 as follows. When the pressure differential between wash tank 154 and vapor tank 150 has been reduced sufficiently, preferably less than about 100 psig, more preferably less than 50 psig, most preferably at or near zero, valves 101 and 104 are shut and compressor 152 is started. Valve 114 is opened and condenser 151 is brought on-line. The remaining vapor in wash tank 154 is transferred through lines 123, 121, and 122 to vapor tank 150. Valve 105 is opened and some of the vapor flowing through line 122 begins to flow through line 127, condense in condenser 151, and flow as liquid through line 128 into working tank 153. When the pressure in wash tank 154 is at or near atmospheric pressure, preferably less than about 100 psig, most preferably less than about 50 psig, compressor 152 is secured and valves 102, 104, 105, and 114 are shut. Any vapor remaining in wash tank 154 may be vented through valve 113. Wash tank 154 is now depressurized and clean clothes may be removed from it.

A condenser must be sized to provide sufficient cooling during peak load conditions. By utilizing condenser 151 to condense only a portion of the carbon dioxide vapor removed from wash tank 154 rather than all or almost all of the vapor, the size of condenser 151 may be drastically reduced because the peak load experienced by the condenser has been drastically reduced. This embodiment may therefore result in lower capital and operating costs.

As carbon dioxide vapor is removed from wash tank 154 as described above, the temperature within wash tank 154 may decrease as the vapor expands. This temperature decrease may cause frozen carbon dioxide, commonly known as dry ice, to form on the clothes in wash tank 154. To reduce or eliminate this cooling effect, it may be desirable to heat the contents of wash tank 154 as the vapor is removed. Heat is preferably supplied using heating element 156 by opening valve 115; however, one skilled in the art will know other ways of providing heat to wash tank 154.

At the beginning of the next wash cycle, clothes to be cleaned may be placed into wash tank 154, which is at atmospheric pressure. As mentioned above, the cleaning solution in working tank 154 is at or near saturated conditions, preferably between about 55 to 62° F. (10 to 17° C.) at between about 681 to 756 psig for a carbon dioxide based system. The pressure differential between working tank 153 and wash tank 154, roughly 700 psig, may be reduced to facilitate safely transferring liquid cleaning solution to wash tank 154 by charging conserved carbon dioxide vapor from vapor tank 150 into wash tank 154 to pressurize it.

Wash tank 154 may be pressurized by charging the conserved carbon dioxide vapor from vapor tank 150 to wash tank 154 as follows. Valves 104 and 101 are opened, allowing vapor to move from vapor tank 150 through lines 122 and 124 to wash tank 154. Valve 101 and line 124 may be sized to provide adequate restriction to the vapor flow to limit the velocity of this gas stream when the differential pressure between vapor tank 150 and wash tank 154 is at its greatest. When this differential pressure has been reduced sufficiently, preferably less than 200 psi differential, valves 103 and 102 may be opened to facilitate vapor transfer by providing an additional flow path through lines 121 and 123. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154 until the differential pressure between working tank 153 and wash tank 154 has been reduced such that it is less than about 300 psig, preferably less than 200 psig, more preferably less than or equal to 100 psig. Then, compressor 152 is secured and valves 103 and 101 are shut. Alternatively, only valve 101 could be shut, keeping valve 103 open and compressor 152 running to facilitate transfer of cleaning solution from the working tank 153 to wash tank 154 as described below. Wash tank 154 has now been pressurized such that the differential pressure between wash tank 154 and working tank 153 is at or near zero and cleaning solution may be transferred safely from working tank 153 to wash tank 154.

Charging conserved carbon dioxide vapor from vapor tank 150 to wash tank 154 rather than generating vapor by vaporizing cleaning solution in an evaporator, still, or storage tank may eliminate the need for an evaporator, a still, or a heating element in the storage tank. Thus, the present invention may reduce capital costs and operating expenses and may be more thermodynamically efficient.

While compressor 152 may be used to pump the remaining conserved carbon dioxide vapor from vapor tank 150 to pressurize wash tank 154 as just described, this process may be somewhat inefficient. As the pressure in wash tank 154 builds, the compressor 152 reaches high compression ratios and the vapor transfer rate through compressor 152 decreases. Thus, compressor 152 may have to run for a long time to pressurize wash tank 154 completely or nearly completely, resulting in energy and time inefficiencies. The vapor charging step described above may be augmented as follows, partially if not completely eliminating these inefficiencies. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154. When compressor 152 begins to reach high compression ratios, valve 105 is opened. Vapor pressure in working tank 153 drops and cleaning solution in working tank 153 begins to boil. Vapor from working tank 153 flows through line 128, through condenser 151 which is off-line, and through line 127 where this vapor joins the flow of vapor in line 122 coming from the compressor 152 and flows into the wash tank through line 124. When the differential pressure between working tank 153 and wash tank 154 has been reduced such that it is at or near zero, compressor 152 is secured and valves 103, 105, and 101 are shut. Wash tank 154 has now been pressurized such that the differential pressure between wash tank 154 and working tank 153 is at or near zero and cleaning solution may be transferred safely from working tank 153 to wash tank 154.

By supplying only a portion rather than all of the carbon dioxide vapor by vaporizing the cleaning solution in working tank 153, the heat that must be supplied to the cleaning solution to make-up for heat lost due to vaporization may be reduced. Thus, the present invention may reduce capital costs and operating expenses and may be more thermodynamically efficient.

Cleaning solution may be transferred from working tank 153 to wash tank 154 by opening valves 112, 110, 108, 101, and 105 and starting pump 155. Cleaning solution moves from working tank 153 through lines 136, 135, 134, and 132 into wash tank 154. When a sufficient amount of cleaning solution has been transferred, pump 155 is secured and valves 112, 110, 108, 101, and 105 are shut. While cleaning solution is being transferred from working tank 153 to wash tank 154, the pressure in vapor tank 150 may be reduced by opening valves 103 and 105, bringing condenser 151 on-line by opening valve 114 and starting compressor 152. This pressure may be reduced to better prepare vapor tank 150 to receive vapor during the next cycle. When pressure in vapor tank 150 has been reduced to preferably less than 100 psig, most preferably less than 50 psig, compressor 152 is secured and valves 103, 105, and 114 are shut.

Alternatively, cleaning solution may be transferred using compressor 152 instead of pump 155. To accomplish this transfer, compressor 152 is allowed to continue running after the differential pressure between vapor tank 150 and wash tank 154 has been reduced such that it is at or near zero. When the outlet pressure of compressor 152 is slightly higher than the pressure in working tank 153, valve 101 is shut and valve 105 is opened such that the outlet pressure from compressor 152 pressurizes the vapor space in working tank 153. Of course, condenser 151 is not providing cooling to the vapor in line 127 because valve 114 is closed. With working tank 153 now under additional pressure, valves 112 and 111 are opened. Cleaning solution is transferred from working tank 153 to wash tank 154 through lines 136 and 135. When a sufficient amount of cleaning solution has been transferred, compressor 152 is secured and valves 112, 111, 105, and 103 are shut. Washing clothes in wash tank 154 is commenced.

Similarly, solution may be transferred from wash tank 154 to working tank 153 using the compressor. Vapor from vapor tank 150 may be transferred to wash tank 154 to raise the pressure in wash tank 154 above that of working tank 153 by opening valves 103 and 101 and starting compressor 152. Solution may then be transferred from wash tank 154 to working tank 153 by opening valves 111 and 112. When the desired amount of solution has been transferred, valves 111 and 112 may be shut, compressor 152 may be secured, and valves 101 and 103 may be shut.

In an alternative embodiment, two dry cleaning systems may be interconnected such that vapor tank 150 is a wash tank for a second system, which may have its own compressor, condenser, pump, and working tank, or preferably share some or all of these components with the first system. When wash tank 150 in the first system is depressurized as described above, the conserved carbon dioxide vapor pressurizes the wash tank in the second system. Thus, these two systems may work together such that the wash cycles are 180° out of phase. For example, when one system is contacting clothes with cleaning solution, the wash tank in the other system may be emptied.

The temperature of the system may increase for a number of reasons, including, but not limited to, heat input from pumping cleaning solution, heat input from ambient and heat input from warming clothes in wash tank 154. It may be desirable to cool down the system for several reasons including maintaining optimal system conditions and preventing overpressure.

Cleaning solution in wash tank 154 may be cooled by transferring vapor from wash tank 154 to condenser 151, condensing the vapor there, and transferring the liquid carbon dioxide to working tank 153. Transferring vapor from wash tank 154 may cause the pressure in wash tank 154 to drop slightly, which may cause vaporization of some of liquid cleaning solution, resulting in removal of heat due to the heat of vaporization of the boiled liquid. The quantity of vapor transferred may be small enough that the differential pressure between wash tank 154 and condenser 151 should provide sufficient driving force to move the vapor. Additionally, the quantity of cleaning solution vaporized may be small enough that no cleaning solution need be added back to the wash tank. Vapor may be transferred by opening valves 101, 105, and 114 causing vapor to flow through lines 124, 122, and 127, condense in condenser 151, and flow as liquid through line 128 into working tank 153. When the solution in wash tank 154 has been sufficiently cooled, valves 101, 105, and 114 may be shut.

Similarly, cleaning solution in working tank 153 may be cooled by transferring vapor from working tank 153 to condenser 151, condensing the vapor there, and returning the liquid carbon dioxide to working tank 154 as follows. Valve 114 may be opened, bringing condenser 151 on-line and allowing vapor in line 128 to condense. When the solution in working tank 153 has been-sufficiently cooled, valve 114 may be shut.

Alternatively, vapor from wash tank 154 may be transferred to vapor tank 150, which may be maintained at a pressure sufficiently below the pressure of wash tank 154 such that the pressure differential between the two tanks drives vapor flow. During a wash cycle, vapor tank 150 is preferably maintained at a pressure less than about 300 psig. Vapor transfer may be performed by opening valves 101 and 104. When the cleaning solution in wash tank 154 reaches the desired temperature, valves 101 and 104 can be shut. The vapor thus transferred may be transferred to condenser 151 using compressor 152 and the resulting liquid carbon dioxide returned to working tank 153 by opening valves 103, 105, and 114 and starting compressor 152 causing vapor to flow through lines 121, 123, 121, 122, and 127, condense in condenser 151 and flow as liquid through line 128 into working tank 153. When the desired amount of vapor has been transferred compressor 152 can be secured and valves 103, 104, and 114 shut.

Similarly, vapor may be transferred from working tank 153 to vapor tank 150 to provide desired cooling to solution in working tank 153 as follows. With valve 114 shut, such that condenser 151 is off-line, valves 105 and 104 may be opened, transferring vapor from working tank 153, which is at a higher pressure, to vapor tank 150, which is at a lower pressure. Preferably, working tank 153 is at system pressure described above and vapor tank is at a pressure less than system pressure, preferably less than 500 psig, more preferably less than 300 psig. Transferring vapor from working tank 153 may cause the pressure in working tank 153 to drop slightly, which may cause vaporization of some of the liquid cleaning solution, resulting in removal of heat due to the heat of vaporization of the boiled liquid. This vapor may be condensed and returned to the working tank as described above.

Figure 2:
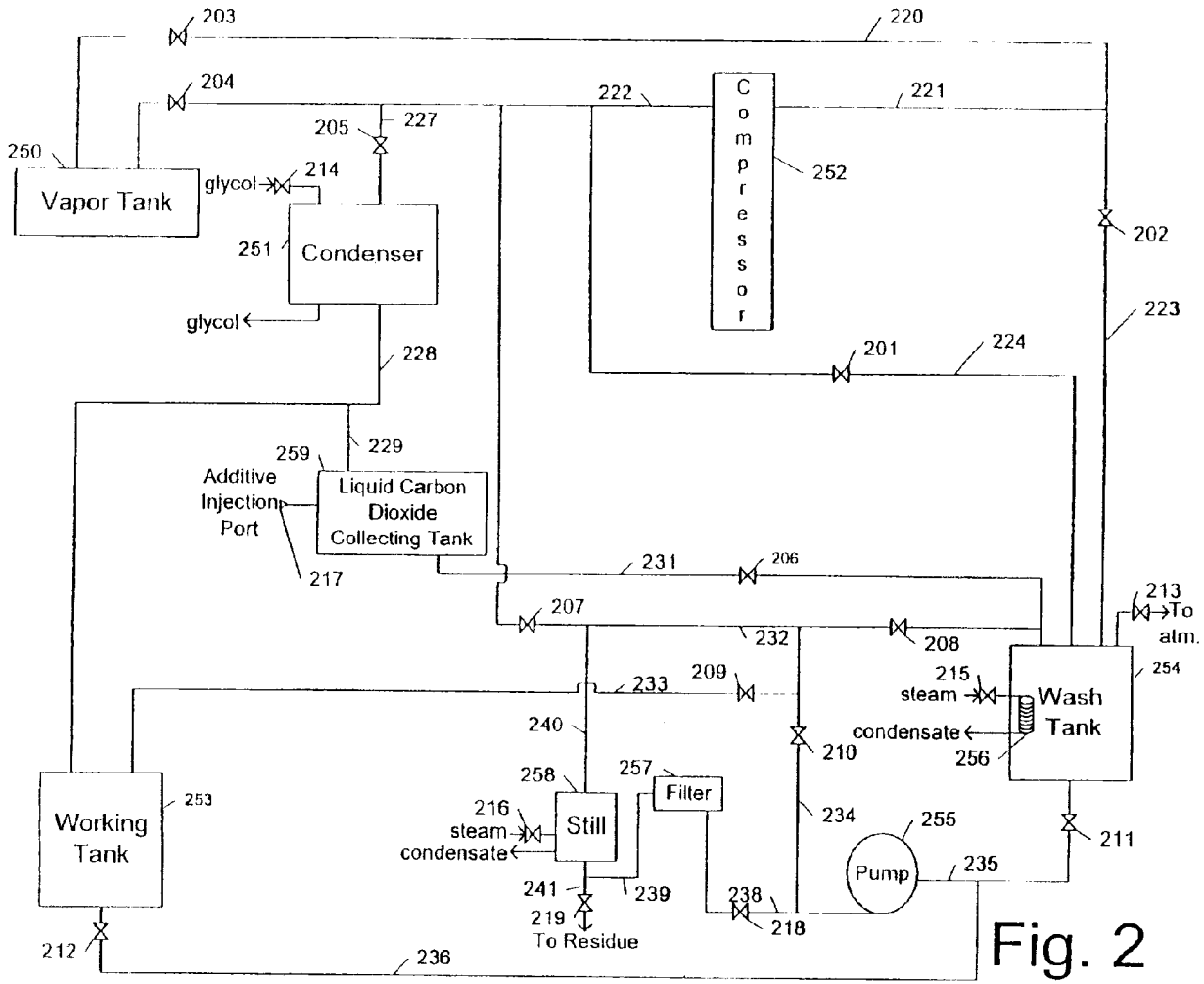
FIG. 2 illustrates a carbon dioxide dry cleaning system employing a vapor tank and a liquid carbon dioxide collecting tank according to the present invention.

Referring now to FIG. 2, a carbon dioxide dry cleaning system employing a vapor tank and a liquid carbon dioxide collecting tank will now be described. Valves 201–215, lines 225–241, and equipment 250–253 correspond to valves 101–115, lines 120–136, and equipment 150–156 in FIG. 1. Additionally, a wash cycle for the system shown in FIG. 2 occurs as described above for the system shown in FIG. 1.

Liquid carbon dioxide collecting tank 259 collects liquid $CO_2$, which may then be used in a variety of ways described below. Liquid carbon dioxide collecting tank 259 has an inlet line 229 and an outlet line 231. Inlet line 229 is connected to line 228, the outlet to condenser 251, such that when liquid flows through line 228 from condenser 251 to working tank 253, the liquid is diverted to liquid carbon dioxide collecting tank 259. Outlet line 231 runs between liquid carbon dioxide collecting tank 259 and wash tank 254. In a preferred embodiment, the elevation of liquid carbon dioxide collecting tank 259 is higher than that of wash tank 254 such that fluid in liquid carbon dioxide collecting tank 259 may be gravity fed through line 231 into wash tank 254 by opening valves 206, 205, and 201. Liquid carbon dioxide collecting tank 259 should have a sufficient volume to perform desired procedures such as rinsing the contents of wash tank 254 or washing filter 257. Liquid carbon dioxide collecting tank preferably has a capacity of about 5 to about 30 gallons and more preferably has a capacity of about 5 to about 15 gallons. When liquid carbon dioxide collecting tank 259 is full, its excess contents may spill out through lines 229 and 228 into working tank 253.

Liquid carbon dioxide collecting tank 259 may be filled with liquid $CO_2$ from a number of different sources either individually or in combination including the following. One source of liquid $CO_2$ may be working tank reflux. The cleaning solution in working tank 253 may heat up due to heat transfer into the tank from higher ambient temperatures. If this happens, the cleaning solution may begin to boil. Vapor will travel from the vapor space in working tank 253 through line 228 into condenser 251. When valve 214 is open and condenser 251 is on-line, the vapor condenses and flows back down line 228 as liquid $CO_2$. This liquid $CO_2$ will flow through line 229 into liquid carbon dioxide collecting tank 259. Another source of liquid $CO_2$ may be the $CO_2$ that condenses during the vapor removal step described above for the system in FIG. 1 where valve 214 is opened and condenser 251 is brought on-line, valve 205 is opened and some of the vapor flowing through line 222 begins to flow through line 227, condense in condenser 251, and flow as liquid through line 228. This liquid $CO_2$ flows into liquid carbon dioxide collecting tank 259. Yet another source of liquid $CO_2$ may be $CO_2$ condensed from distillation of cleaning solution in still 258. Cleaning solution may be transferred to still 258 and distilled to separate the $CO_2$ solvent from surfactants and contaminates among other things. Cleaning solution is transferred by opening valves 211, and 218 and starting pump 255. When the desired amount of cleaning solution has been transferred, pump 255 is secured and valves 210 and 212 are shut. The cleaning solution in still 258 is distilled by opening valve 216, bringing still 258 on-line. Valve 214 is opened and condenser 251 is brought on-line, then valves 207 and 205 are opened and vapor flows from still 258 through lines 240, 232, 222, and 227 into condenser 251 where it condenses. Liquid $CO_2$ then flows through lines 228 and 229 into liquid carbon dioxide collecting tank 259. Still another source of liquid $CO_2$ may be wash tank reflux that occurs when liquid in wash tank 254 is heated by opening valve 215, bringing heating element 256 on-line. Valve 214 is opened and condenser 251 is brought on-line, then valves 208, 207, and 205 are opened. Vapor flows from wash tank 254 through lines 232, 222, and 227 into condenser 251 where it condenses. The liquid $CO_2$ flows through lines 228 and 229 into liquid carbon dioxide collecting tank 259. Another source of liquid CO2 may be vapor transfer from vapor tank 250 after a system cooling procedure has been performed as described above for the system in FIG. 1.

Liquid $CO_2$ in liquid carbon dioxide collecting tank 259 may be used to rinse clothes in wash tank 254 as follows. Liquid carbon dioxide collecting tank 259 has been filled with liquid $CO_2$ as described above. A wash cycle, as described above for the system in FIG. 1, proceeds through the extraction step. Valves 206, 205, and 201 are opened allowing the contents of the liquid carbon dioxide collecting tank 259, in this case liquid $CO_2$, to flow through line 231 into wash tank 254. When the desired amount of liquid $CO_2$ has been added to wash tank 254, valves 206, 205, and 201 are shut. Clothes in wash tank 254 are contacted with the liquid $CO_2$ for a sufficient amount of time to rinse any residual cleaning solution from the clothes. The drain and extraction steps described above for the system in FIG. 1 are then repeated to remove the rinse solution from wash tank 254, and the carbon dioxide vapor in wash tank 254 may be removed as described above for the system in FIG. 1. Liquid carbon dioxide collecting tank 259 may be refilled by one of the methods described above.

Liquid in liquid carbon dioxide collecting tank 259 may be used to wash filter 257. One who is skilled in the art will appreciate that the cleaning system could include one or more than one filter in many different configurations. Liquid carbon dioxide collecting tank 259 has been filled with liquid carbon dioxide as described above. A wash of the filter may be performed as a periodic operation. In the preferred embodiment, a wash may be performed on a weekly basis, more preferred for commercial operations at a time when cleaning operations are not scheduled. The filter wash may be initiated by employees as they leave for the day. The cycle would commence and follow a normal wash cycle, as described above for the system in FIG. 1, through the vapor charging step with the exception that no clothes would be added to wash tank 154. During this time, additives may be added to the liquid $CO_2$ in liquid carbon dioxide collecting tank 259 through additive injection port 217 to form a filter wash solution. These additives may shift the adsorption equilibrium of adsorbed dyes or other contaminants such that they become soluble in liquid carbon dioxide. The precise additive needed to clean filter 257 will depend on the type of contaminant to be removed from it and will be known to those skilled in the art. If no additives are added to liquid carbon dioxide collecting tank 259, the filter wash solution consists of liquid carbon dioxide.

The contents of liquid carbon dioxide collecting tank 259 are added to wash tank 254 by opening valves 206, 205, and 201, allowing the filter wash solution to flow through line 231. When the desired amount of filter wash solution has been transferred to wash tank 254, valves 206, 205, and 201 are shut. Valves 211, 218, and 208 are opened and pump 255 is started. Filter wash solution is circulated from wash tank 254 through lines 235 and 238, through filter 257, through lines 239 and 241, through still 258, which is off-line, and through lines 240 and 232 back to wash tank 254. After washing filter 257 for a sufficient amount of time, preferably between about 1 and 600 minutes, most preferably between 1 and 20 minutes, the filter wash solution may be transferred either to working tank 254 or to still 258. Filter wash solution may be transferred to working tank 254 by shutting valve 208 and opening valves 209, 201, and 205. When wash tank 254 is empty, pump 255 is secured and valves 211, 218, 209, 201, and 205 are shut. Alternatively, filter wash solution may be transferred from wash tank 254 to still 258 by shutting valve 208. When wash tank 254 is empty, pump 255 is secured and valves 218 and 211 are shut. Filter 257 may be positioned at an elevation above still 258 so that filter 257 may be drained into still 258 by gravity. The filter wash solution may then be distilled by opening valves 207 and 205, then opening valves 216 and 214, bringing the still and the condenser on-line. Vapor from the still travels through lines 240, 232, 222, 227, condenses in condenser 251, then liquid carbon dioxide travels through line 228 into liquid carbon dioxide collecting tank 259. When the contents of still 258 have been distilled, valves 216, 214, 207, and 205 are shut. Carbon dioxide vapor in wash tank 254 may be removed as described above for the system in FIG. 1. Liquid carbon dioxide collecting tank 259 may be refilled by one of the methods described above.

Liquid in liquid carbon dioxide collecting tank 259 may be used to help remove non-volatile residues present on clothes in wash tank 254 after the wash cycle. Liquid carbon dioxide collecting tank 259 has been filled with liquid $CO_2$ as described above. A wash cycle, as described above for the system in FIG. 1, proceeds through the extraction step. Before the vapor removal step, a second extraction step may be performed as follows. Valves 206, 205, and 201 are opened allowing the contents of the liquid carbon dioxide collecting tank 259, in this case liquid $CO_2$, to flow through line 231 into wash tank 254. Clothes in wash tank 254 are contacted with the liquid $CO_2$ for a sufficient amount of time to remove some or all of the remaining non-volatile residues from the clothes. During this time, heating element 256 is brought on-line by opening valve 215. As the liquid in wash tank 254 boils, the carbon dioxide vapor created condenses on the cooler clothes that are in wash tank 254, which may extract the residues. The condensed carbon dioxide vapor falls back to the bottom of wash tank 254 and may be reboiled. After this second extraction step has been performed for a sufficient time, heating element 256 is taken off-line by shutting valve 215. The drain and extraction steps described above for the system in FIG. 1 may be repeated to remove the liquid from wash tank 254. Wash tank 254 may be depressurized as described above for the system in FIG. 1. Liquid carbon dioxide collecting tank 259 may be refilled by one of the methods described above.

The present invention may be carried out in an any suitable carbon dioxide dry cleaning apparatus, particularly an apparatus as described in J. McClain et al., copending U.S. patent application Ser. No. 09/047,013 (filed Mar. 24, 1998); an apparatus as described in J. McClain et al., copending U.S. patent application Ser. No. 09/306,360 (filed May 6, 1999)(disclosing a preferred direct drive system); an apparatus as disclosed in J. DeYoung et al., copending U.S. patent application Ser. No. 09/312,556 (filed May 14, 1999); and an apparatus as described in U.S. patent application Ser. No. 09/405,619 filed concurrently herewith, to McClain et al. entitled System for the Control of a Carbon Dioxide Cleaning Apparatus which is commonly assigned to the assignee of the present invention, the disclosures of all of which is incorporated by reference herein in its entirety.

While the embodiments described above have focused on methods and apparatus for contacting clothes with a liquid carbon dioxide solution, one skilled in the art will appreciate that the methods and apparatus described above could be used for contacting other articles, including but not limited to parts and tools.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method of supplying a liquid carbon dioxide solution to a wash tank for a carbon dioxide dry cleaning system, utilizing a vapor tank, a condenser, a liquid carbon dioxide collecting tank, a working tank containing carbon dioxide cleaning solution, and a wash tank, said method comprising the steps of:

draining a solution comprising liquid carbon dioxide from the wash tank leaving vapor carbon dioxide in the wash tank;

transferring the carbon dioxide vapor from the wash tank to a vapor tank;

condensing a portion of the carbon dioxide vapor transferred to the vapor rank to form liquid carbon dioxide;

collecting the liquid carbon dioxide in the liquid carbon dioxide collecting tank; and draining the contents of the liquid carbon dioxide collecting tank into the wash tank.

2. A method according to claim 1 further comprising the steps of:

rinsing articles in the wash tank with liquid carbon dioxide after the draining step; and emptying the contents of the wash tank into the working tank.

3. A method according to claim 2 wherein the rinsing step comprises the steps of:

boiling the liquid carbon dioxide in the wash tank to generate carbon dioxide vapor;

condensing the carbon dioxide vapor to form liquid carbon dioxide; and returning the liquid carbon dioxide to the wash tank.

4. A method according to claim 1 further comprising the steps of:

washing at least one filter with the contents of the liquid carbon dioxide collecting tank after the draining step.

5. A method according to claim 4 further comprising the step of:

injecting additives into the liquid carbon dioxide collecting tank to form a filter wash solution after the collecting step and before the draining step.

6. A method according to claim 4 further comprising the steps of:

draining the contents of the wash tank to a still; and distilling the filter wash solution to separate contaminants from the carbon dioxide.

7. A method according to claim 4 further comprising the steps of:

draining the contents of at least one filter to a still; and distilling the contents to separate contaminants from the carbon dioxide.

* * * * *

UNITED STATES PATENT AND TRADEMARK OFFICE

CERTIFICATE OF CORRECTION

PATENT NO. : 6,921,420 B2
DATED : July 26, 2005
INVENTOR(S) : Brainard et al.

It is certified that error appears in the above-identified patent and that said Letters Patent is hereby corrected as shown below:

Title page,
Item [56], References Cited, U.S. PATENT DOCUMENTS, should include:
-- 6,001,133 12/1999 DeYoung et al. --.

Signed and Sealed this

Twenty-fourth Day of January, 2006

JON W. DUDAS
*Director of the United States Patent and Trademark Office*